United States Patent [19]

Andersson

[11] Patent Number: 4,821,649

[45] Date of Patent: Apr. 18, 1989

[54] SHEET METAL SHELVING

[75] Inventor: Olof I. Andersson, Säffle, Sweden

[73] Assignee: Electrolux Constructor Aktiebolag, Säffle, Sweden

[21] Appl. No.: 95,124

[22] Filed: Sep. 10, 1987

[30] Foreign Application Priority Data

Sep. 23, 1986 [SE] Sweden ..... 8603998

[51] Int. Cl.[4] ..... A47B 9/00

[52] U.S. Cl. ..... 108/107; 108/110; 108/111; 211/187

[58] Field of Search ..... 108/107, 110, 111, 114, 108/109, 108; 211/135, 187, 190, 207, 208, 191

[56] References Cited

U.S. PATENT DOCUMENTS

| | | | |
|---|---|---|---|
| 1,302,882 | 5/1919 | Terrell | 108/109 |
| 1,937,935 | 12/1933 | Zimmerman | 108/110 |
| 1,952,111 | 3/1934 | Batts | 108/107 |
| 1,963,427 | 6/1934 | Tyler | 108/110 |
| 1,984,473 | 12/1934 | Gibson et al. | 108/107 X |
| 2,132,743 | 10/1938 | Marchant | 108/110 |
| 2,231,261 | 2/1941 | Eustis | 108/114 |
| 3,693,556 | 9/1972 | Rous | 108/11 K |
| 3,862,691 | 1/1975 | Mori et al. | 211/191 |
| 4,101,108 | 7/1978 | Klein | 108/114 X |
| 4,101,233 | 7/1978 | McConnell | 211/187 X |
| 4,201,139 | 5/1980 | Suttles | 108/109 |
| 4,317,523 | 3/1982 | Konstant et al. | 108/107 X |
| 4,351,244 | 9/1982 | Suttles | 108/107 |
| 4,607,576 | 8/1986 | Kranjec | 108/107 |
| 4,645,276 | 2/1987 | Flavigny | 108/107 X |

FOREIGN PATENT DOCUMENTS

| | | | |
|---|---|---|---|
| 779115 | 2/1908 | Canada | 108/109 |
| 1185797 | 8/1959 | France | 108/110 |

*Primary Examiner*—Kenneth J. Dorner
*Assistant Examiner*—José V. Chen
*Attorney, Agent, or Firm*—Alfred E. Miller

[57] ABSTRACT

This invention relates to a sheet metal shelving comprising posts and shelves. The posts include a waist which by means of a first flange is connected to a second flange. The waist abuts a first edge part of the shelf whereas the second flange engages recesses in a second edge part of the shelf. The second edge part forms a closed torsion resistant profile with several in vertical direction separated extending flanges having said recesses.

4 Claims, 2 Drawing Sheets

SHEET METAL SHELVING

This invention relates to a sheet metal shelving assembly comprising posts and shelves.

BACKGROUND OF THE INVENTION

Shelving assemblies of the above type are previously known and used for storing various types of articles. Such shelving assemblies with the exception of posts and shelves comprise several loose details for joining the shelves to the posts and for fixing the posts. Thus, often screw elements are used to fasten the shelves to the posts, as well as to fasten cross stays or stringers to the posts for securing them. In order to reduce the number of details it has also been proposed to use shelving assemblies with different types of shelves, which without separate locking means can be fixed to the posts. In such shelving assemblies the shelves for instance rest on hooks extending from the posts. However, there is a risk that there will be play between the parts upon continued use. Such play has a negative effect on the stability of the assembly and is often created by a weak shelf structure and by overloading the assembly. Also, in these type of assemblies, it is necessary to stay the posts in any suitable way, in particular if the assembly has to support heavy loads.

Principal feature of this invention is to create a rigid shelving assembly without the use of stays with the shelving generally speaking only consisting of two basic elements namely posts and shelves. This is achieved by a shelving assembly hereinafter described.

BRIEF DESCRIPTION OF THE DRAWINGS

An embodiment of the invention will now be described with reference to the accompanying drawing in which FIG. 1 is a partly broken away perspective view of a shelving assembly according to the invention whereas

DESCRIPTION OF THE PREFERRED EMBODIMENT

Figure 1:
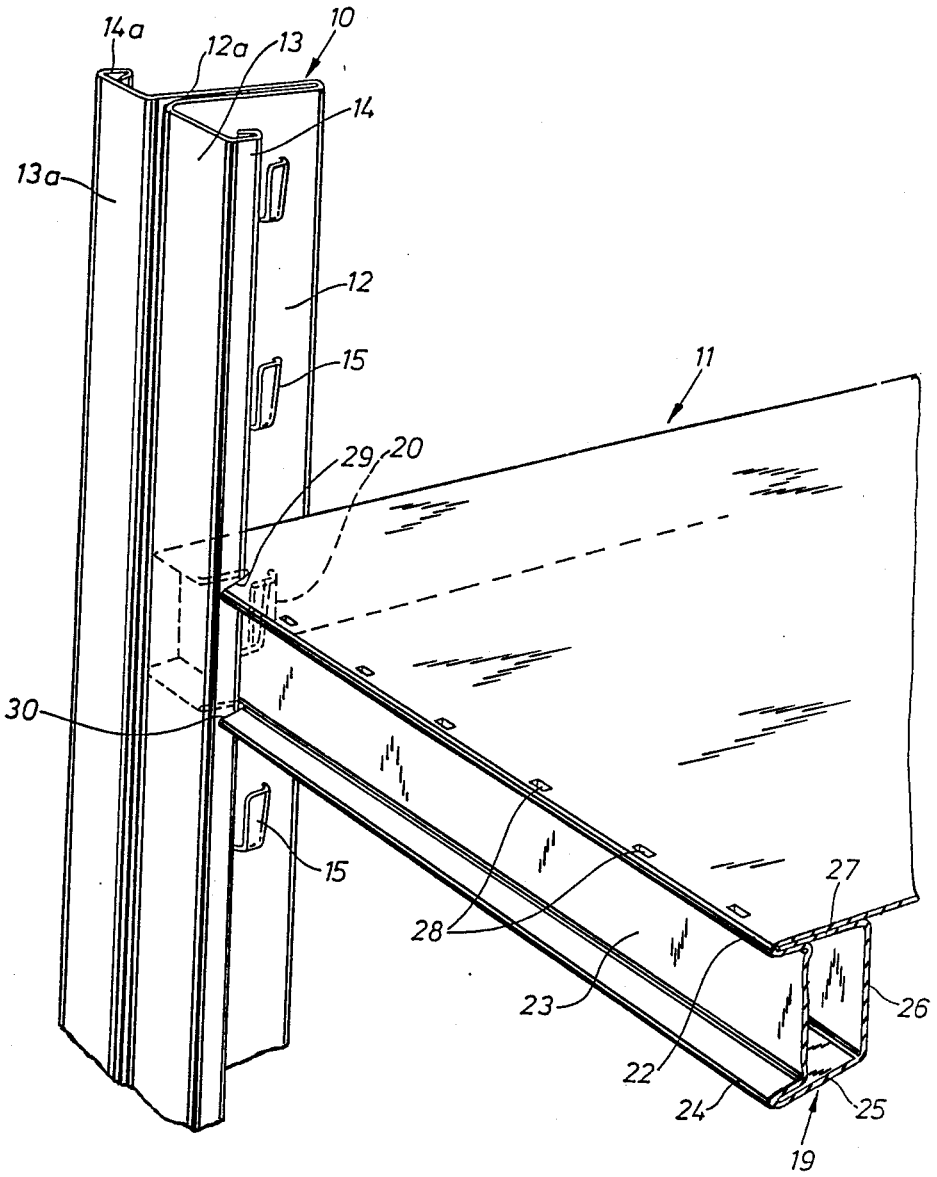
Figure 2:
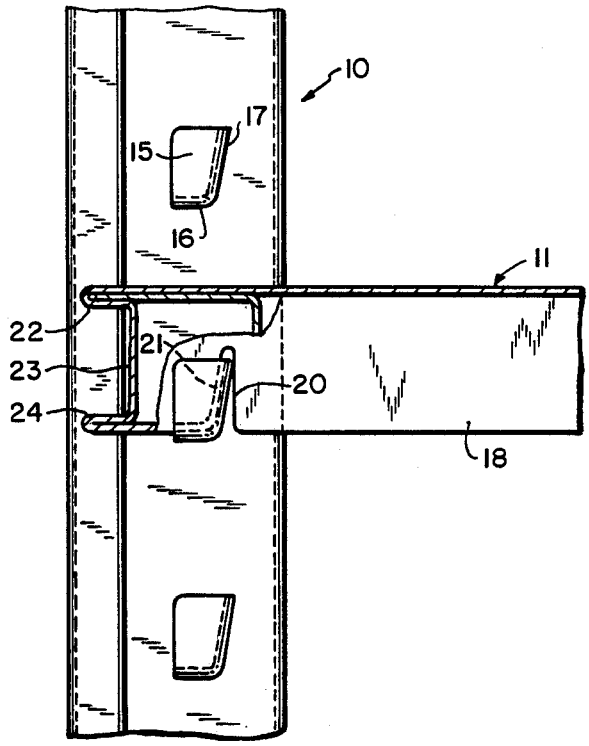
FIG. 2 is a vertical section through the shelving assembly and FIG. 3 is a plan view of the shelving assembly.
Figure 3:
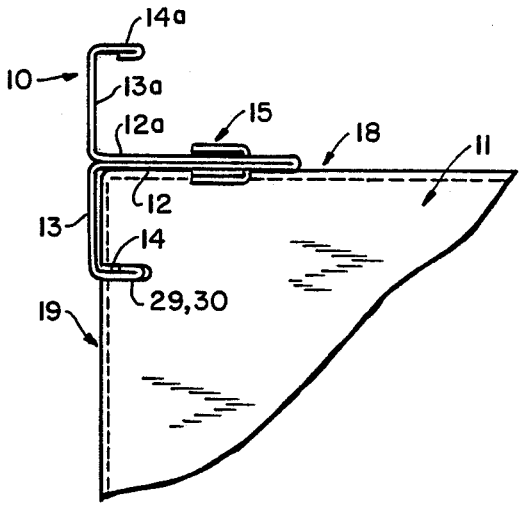

As appears from FIGS. 1–3 the assembly comprises posts 10 and shelves 11. The posts 10 are manufactured by bending a comparatively thick sheet metal plate forming a waist 12 which by means of a first flange 13 perpendicular to the waist 12 continues into a second flange 14 which is parallel to the waist 12. The last mentioned flange 14 is manufactured by bending the edge part of the plate to a double layer structure. Also the waist 12 continues with a 180° bend into a mirror symmetrical arrangement with a waist 12*a* and flanges 13*a* and 14*a* respectively. The waist 12, as well as its mirrors symmetrical equivalents 12*a*, has several lugs 15 spaced from each other, these lugs being punched out from the sheet metal plate. As seen in FIG. 2, the lugs 15 are connected to the waist 12 at their lower part 16 and at one side 17 extending mainly downwards and inwards towards the first flange 13 of the post so that a slot which is open upwards and inwards towards the flange 13 between the waist 12 and the lug 15 is created. Preferably the lug has such a shape that the width of the slot decreases somewhat in the downward direction in order to pinch the shelves to the post.

The shelf 11 is manufactured from a sheet metal plate which is bent so that a first edge part 18 and a second edge part 19 are formed the edge parts being arranged at right angles to each other.

The first edge part 18 comprises a bend which is downwardly directed and perpendicular to the upper surface of the shelf and which has a recess 20 near the corner of the shelf. This recess 20 has the character of an inverted slightly V-shaped slot one edge 21 cooperating with and having about the same inclination to the length direction of the post as one side 17 of the lug 15.

The second edge part 19 has a boxlike profile where the sheet plate is bent so that an upper flange 22 is formed which is a continuation of the upper side of the shelf and which via a vertical part 23 is connected to a lower flange 24 extending into a horizontal part 25. This horizontal part then continues as a vertical part 26 which continues into another horizontal part 27 supporting the upper side of the shelf. The outer end of this part 27 is inserted between the two bent parts of the sheet plate forming the upper flange 22 whereby the flange 22 and the horizontal part 27 are fixed to each other by means of several punched out lugs 28, by spot welding or by any other suitable manner.

Both the upper and the lower flanges 22 and 24 have, near the corners of the shelf, a recess 29 and 30 respectively which cooperate with the second flange 14 of the post.

The elements cooperate as follows. In order to mount the shelvings assembly the corner of the shelf 11 is inserted down into the post 10 so that the edge part 18 is placed between the lug 15 and the waist 12 of the post and the edge 21 of the recess 20 engages the side 17 of the lug 15. At the same time the flange 14 of the post enters the recesses 29 and 30 at the edge part 19 which means that the shelf is locked against movement in the length direction of the second edge part 19. When loading the shaft the edge 21 of the recess 20 will be pressed against the side 17 of the lug 15 which means that the flanges 22 and 24 between the recesses 29, 30 are forced to abut the first flange 13 of the post. Increased load means increased engaging forces.

By the existence of a comparatively large and torsion resistant second edge part 19 of the shelf and a corresponding abutting surface of the post the joint between the shelf and post will be so stiff that further means for stabilizing the posts are not necessary which means that the number of elements in the shelving assembly is are reduced to a mininum.

I claim:

1. A shelving assembly comprising a plurality of upright posts and at least one shelf extending substantially perpendicular to said posts, each of said posts having a first upright flange and a vertically extending second flange perpendicular thereto and being provided with a waist section extending substantially perpendicular to said first flange and parallel with and extending in the same direction as the second flange having at least one lug thereon for latching said shelf to said upright posts, said shelf having a first edge part extending downward from the shelf and having recesses therein adjacent to the corners of said shelf, a second edge part positioned perpendicular to the first edge part and having a boxlike profile in which the edge is bent to form an outwardly extending upper edge flange, a vertical part and an outwardly extending lower edge flange parallel to the upper edge flange, vertically aligned notches in said upper and lower edge flanges adjacent to the corner of said shelf, and when the shelf is mounted on said posts a portion of said first edge part engages said waist section and said lugs are inserted in respective recesses in said first edge part, the corners of said shelf being so shaped that when said shelf is mounted on said posts said upper and lower edge flanges abut said first flange of said post and at the same time the second flange of said post is inserted in said notches whereby the shelf and the posts supporting the shelf are rigidly connected together.

2. A shelving assembly as claimed in claim 1 wherein said box-like edge profile of said shelf is a continuous strip.

3. A shelving assembly as claimed in claim 1 wherein each of said lugs on the waist section of said post engage an adjacent recess on said first edge part, and said lug being open in the side thereof facing said first flange.

4. A shelving assembly as claimed in claim 1 wherein each post comprises two connected halves that are mirror images of each other forming a T-shaped configuration with the continuous waist section being the base of the T.

* * * * *